US009276333B1

(12) United States Patent
Wu

(10) Patent No.: US 9,276,333 B1
(45) Date of Patent: Mar. 1, 2016

(54) TERMINAL BLOCK WITH IMPROVED RAIL-ENGAGING STRUCTURE

(71) Applicant: DINKLE ENTERPRISE CO., LTD., New Taipei (TW)

(72) Inventor: Shang Tsai Wu, New Taipei (TW)

(73) Assignee: DINKLE ENTERPRISE CO., LTD., New Taipei (TW)

( * ) Notice: Subject to any disclaimer, the term of this patent is extended or adjusted under 35 U.S.C. 154(b) by 0 days.

(21) Appl. No.: 14/642,354

(22) Filed: Mar. 9, 2015

(51) Int. Cl.
*H01R 9/26* (2006.01)
*H01R 9/24* (2006.01)

(52) U.S. Cl.
CPC ..... *H01R 9/24* (2013.01)

(58) Field of Classification Search
CPC ..... H01R 9/24; H01R 9/2416; H01R 9/26
USPC ..... 439/715, 716, 110
See application file for complete search history.

(56) References Cited

U.S. PATENT DOCUMENTS 4,067,529 A * 1/1978 Milcoy ..... H02B 1/052 248/214
7,522,428 B2 * 4/2009 Nguyen ..... H02B 1/052 361/759
8,062,061 B2 * 11/2011 Lim ..... H02B 1/052 439/532
8,379,398 B2 * 2/2013 Correll ..... 361/741
8,647,158 B2 * 2/2014 Kawabata ..... H01R 9/2608 439/716
8,651,442 B2 * 2/2014 Takaya ..... H02B 1/052 248/225.21
2001/0051466 A1 * 12/2001 Bechaz ..... H01R 9/2691 439/716
2002/0072256 A1 * 6/2002 Lostoski ..... H01R 9/26 439/76.1
2008/0299820 A1 * 12/2008 Schelonka ..... H01R 9/2608 439/532
2014/0226287 A1 * 8/2014 V ..... H02B 1/052 361/747

* cited by examiner

*Primary Examiner* — Tulsidas C Patel
*Assistant Examiner* — Marcus Harcum
(74) *Attorney, Agent, or Firm* — Birch, Stewart, Kolasch & Birch, LLP

(57) ABSTRACT

A terminal block includes a terminal block body, an engaging member, an elastic member, and a hook member. The terminal block body includes left and intermediate blocking portions. The engaging member is slidably provided on the terminal block body and includes a clawed operating portion, a connecting portion connected to the operating portion, and a stop block provided on the operating portion in order to be blocked by the left blocking portion. A blocking portion is formed where the connecting portion and the operating portion are connected. The elastic member is provided in the operating portion and pressed between the intermediate blocking portion and the blocking portion. The hook member includes an upper end movably connected to the connecting portion, a hooked lower end, and a pivotal connecting portion located therebetween and pivotally connected to the terminal block body. The terminal block is space-saving and features increased convenience of operation.

7 Claims, 8 Drawing Sheets

TERMINAL BLOCK WITH IMPROVED RAIL-ENGAGING STRUCTURE

BACKGROUND OF THE INVENTION

1. Technical Field

The present invention relates to a terminal block with an improved rail-engaging structure. More particularly, the present invention relates to a terminal block which has an improved rail-engaging structure, is space-saving, and features increased convenience of operation.

2. Description of Related Art

Terminal blocks are electronic components extensively used in a variety of machines to connect at least two power cords, control cables, or data transmission lines.

Referring to FIG. 1 for a perspective view of a conventional terminal block 9, the conventional terminal block 9 has a rail-engaging structure 91 which can slide in the left-right direction against or due to the elastic force of a spring (not shown) provided in the rail-engaging structure 91.

FIG. 2 shows a state of use of the conventional terminal block 9, in which the terminal block 9 is engaged with a rail 8. More specifically, as shown FIG. 2, the terminal block 9 is engaged with the rail 8 via the rail-engaging structure 91. To do so, the rail-engaging structure 91 is pulled outward with a tool, such as a screw driver (not shown), in order to put the rail 8 into the space thus formed. Once the rail 8 is in place, the tool is removed, allowing the rail-engaging structure 91 to return to its original position under the elastic force of the spring and thereby engage with the rail 8.

FIG. 3 demonstrates how the terminal block in FIG. 2 engages with the rail 8. In order for the terminal block 9 to engage with the rail 8, referring to FIG. 3, the entire terminal block 9 must be tilted so that the fixed side 92 of the terminal block 9 engages with the rail 8 first. Then, the entire terminal block 9 is rotated so that the rail-engaging structure 91, which is slidable in the left-right direction, is brought into engagement with the rail 8 by the elastic force of the spring.

According to above, the process of engaging the conventional terminal block 9 with the rail 8 not only is complicated and inconvenient, but also requires a large space for the engaging operation. In other words, there is still room for improvement.

BRIEF SUMMARY OF THE INVENTION

The present invention provides a terminal block having an improved rail-engaging structure, wherein the terminal block includes a terminal block body, an engaging member, an elastic member, and a hook member.

The terminal block body includes a left blocking portion, a right end portion, and an intermediate blocking portion located between the left blocking portion and the right end portion. The engaging member is slidably provided on the terminal block body and includes an operating portion, a connecting portion, and a stop block. The operating portion is formed with a receiving groove and has an end facing the right end portion and protrudingly provided with a claw. The connecting portion has one end connected to the operating portion such that a blocking portion is formed at the junction between the aforesaid end of the connecting portion and the operating portion. The stop block is protrudingly provided on the operating portion and is adjacent to the left blocking portion so as to correspond to and be blocked by the left blocking portion. The elastic member is provided in the receiving groove, is pressed between the intermediate blocking portion and the blocking portion, and has an elastic force.

The hook member includes a pivotal connecting portion, an upper end, and a lower end. The pivotal connecting portion is located between the upper end and the lower end and is pivotally connected to the terminal block body. The upper end is movably connected to an opposite end (hereinafter referred to as the second end) of the connecting portion. The lower end is protrudingly provided with a hook facing the left blocking portion.

The structural designed described above is space-saving and helps increase convenience of operation.

Preferably, the end of the operating portion that is opposite the end protrudingly provided with the claw is formed with an operation hole.

Preferably, the upper end is movably connected to the second end of the connecting portion via a flexible thin wall.

Alternatively, it is preferable that the upper end is movably connected to the second end of the connecting portion via a pivot pin.

Preferably, the elastic member is a spring.

Preferably, the terminal block body is formed with a supporting portion, the engaging member is slidably provided on the supporting portion of the terminal block body, and the right end portion is formed at one end of the supporting portion.

Preferably, the terminal block body further includes a cover covering the engaging member, the elastic member, and the hook member, the intermediate blocking portion and the supporting portion are formed on the cover; and the pivotal connecting portion of the hook member is pivotally connected to the cover.

DETAILED DESCRIPTION OF THE INVENTION

Figure 1:
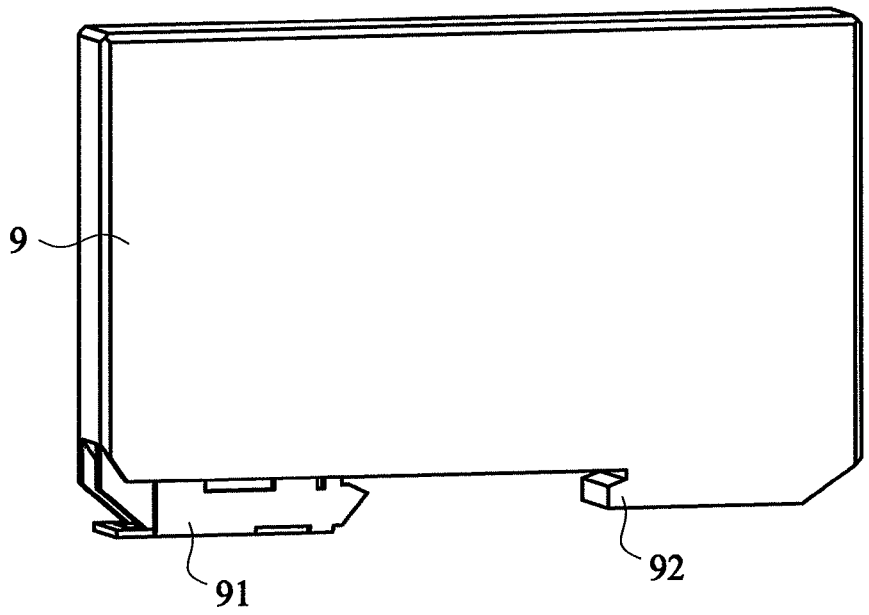
FIG. 1 (Prior Art)
FIG. 1 is a perspective view of a conventional terminal block.
Figure 2:
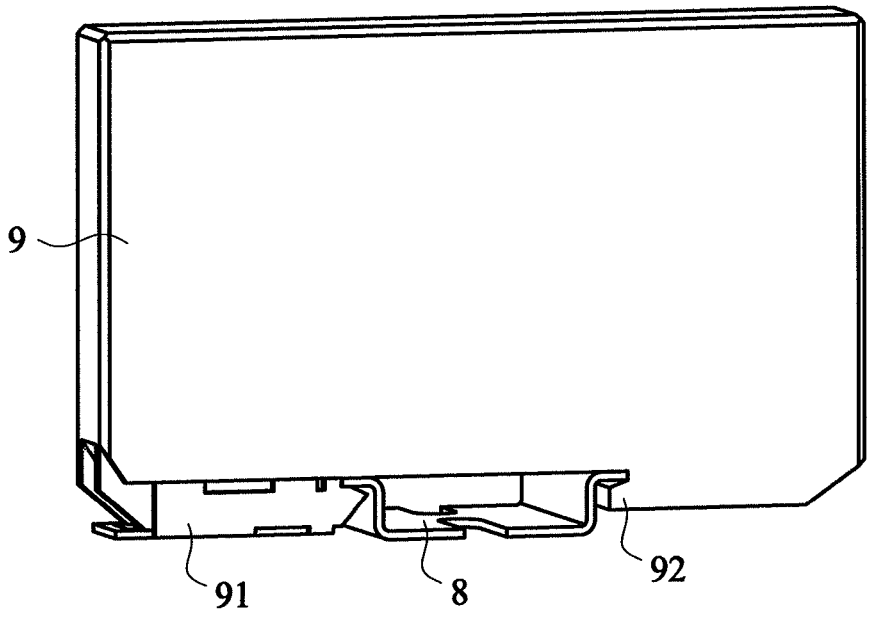
FIG. 2 (Prior Art)
FIG. 2 shows a state of use of the conventional terminal block in FIG. 1, or more particularly a state in which the conventional terminal block is engaged with a rail.
Figure 3:
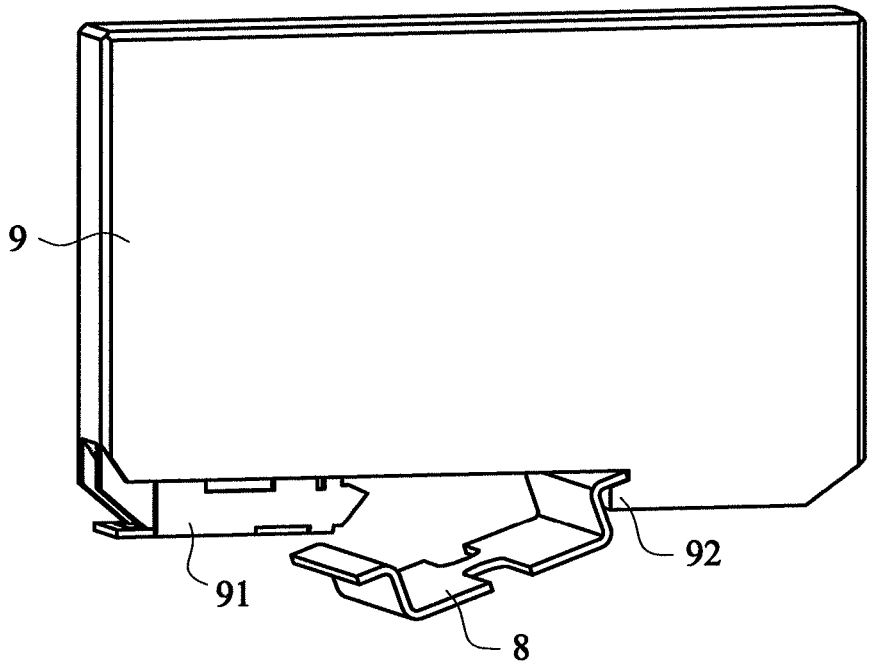
FIG. 3 (Prior Art)
FIG. 3 shows how the terminal block in FIG. 2 is engaged with the rail.
Figure 4:
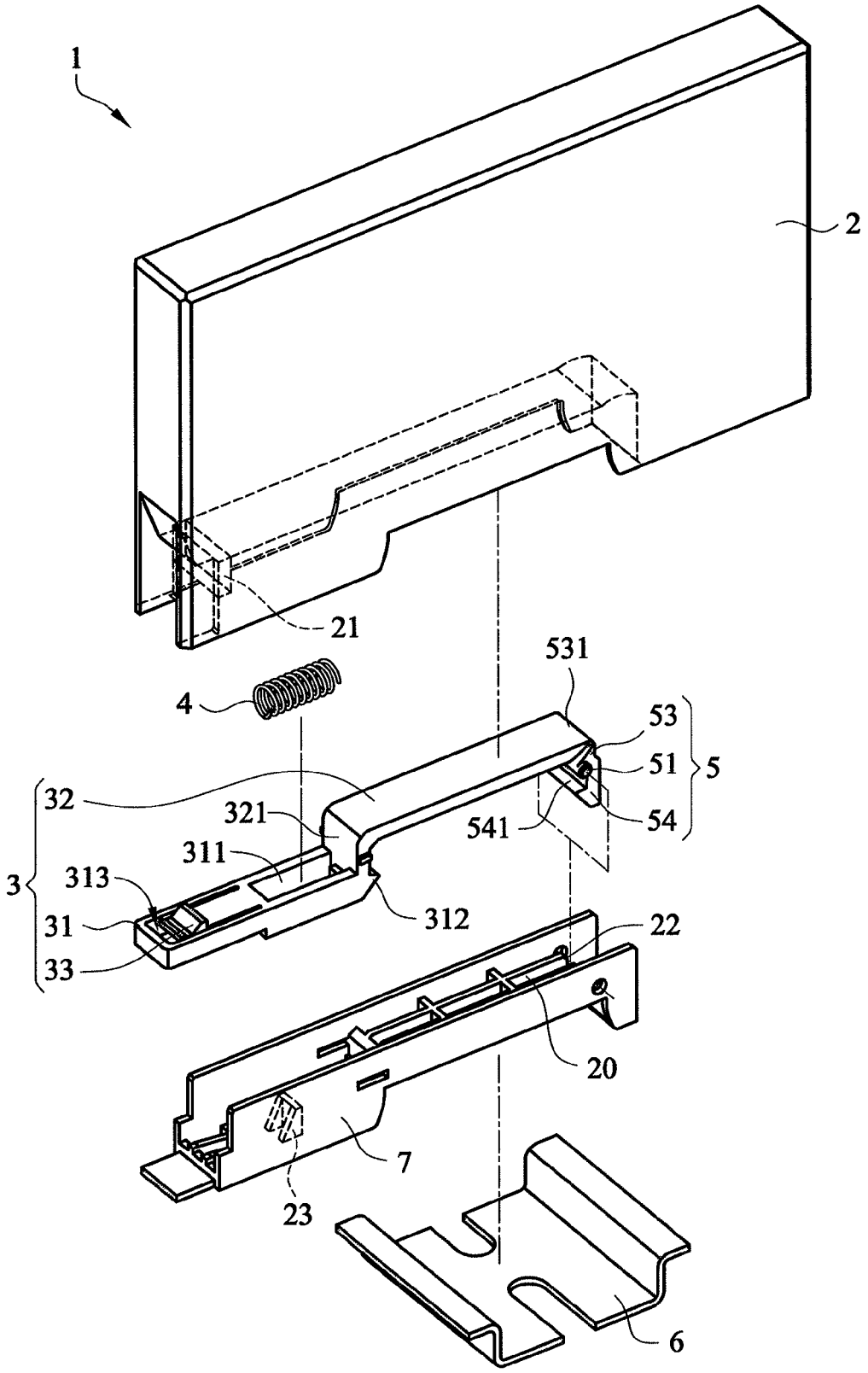
FIG. 4 is an exploded view of the first preferred embodiment of the present invention.
Figure 5:
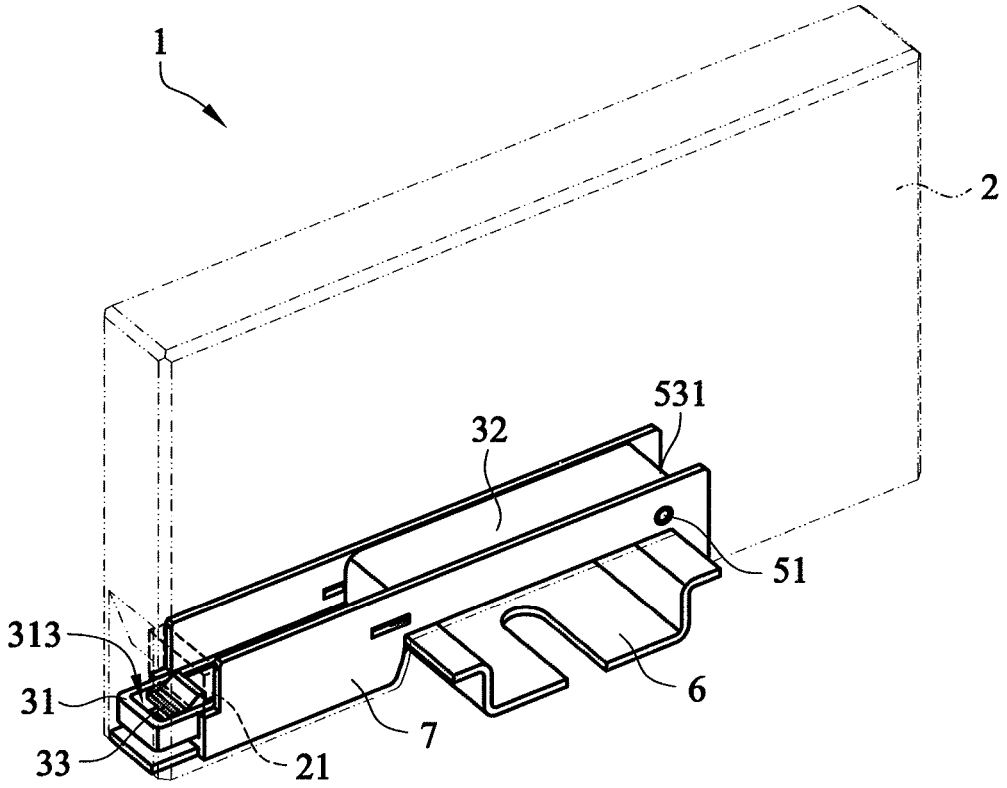
FIG. 5 is a perspective view of the first preferred embodiment of the present invention.

Please refer to FIG. 4 and FIG. 5 respectively for an exploded view and a perspective view of the first preferred embodiment of the present invention.

As shown in FIG. 4 and FIG. 5, a terminal block 1 with an improved rail-engaging structure includes a terminal block body 2, an engaging member 3, an elastic member 4, and a hook member 5.

The terminal block body 2 includes a left blocking portion 21, a right end portion 22, and an intermediate blocking portion 23. The intermediate blocking portion 23 is located between the left blocking portion 21 and the right end portion 22. The engaging member 3 is slidably provided on the terminal block body 2 and includes an operating portion 31, a connecting portion 32, and a stop block 33. The operating portion 31 is formed with a receiving groove 311. The end of the operating portion 31 that faces the right end portion 22 of the terminal block body 2 is protrudingly provided with a claw 312. One end of the connecting portion 32 is connected to the operating portion 31, and a blocking portion 321 is formed at the junction between the aforesaid end of the connecting portion 32 and the operating portion 31. The stop block 33 is protrudingly provided on the operating portion 31 and is adjacent to the left blocking portion 21 of the terminal block body 2 so as to correspond to and be blocked by the left blocking portion 21. The elastic member 4 is provided in the receiving groove 311 of the operating portion 31 and is pressed between the intermediate blocking portion 23 of the terminal block body 2 and the blocking portion 321 of the connecting portion 32. The elastic member 4 has an elastic force. The hook member 5 includes a pivotal connecting portion 51, an upper end 53, and a lower end 54. The pivotal connecting portion 51 is located between the upper end 53 and the lower end 54 and is pivotally connected to the terminal block body 2. The upper end 53 is movably connected to the other end (hereinafter referred to as the second end) of the connecting portion 32 of the engaging member 3. The lower end 54 is protrudingly provided with a hook 541 facing the left blocking portion 21 of the terminal block body 2.

The structural design described above can effectively save space and increase convenience of operation.

Figure 6:
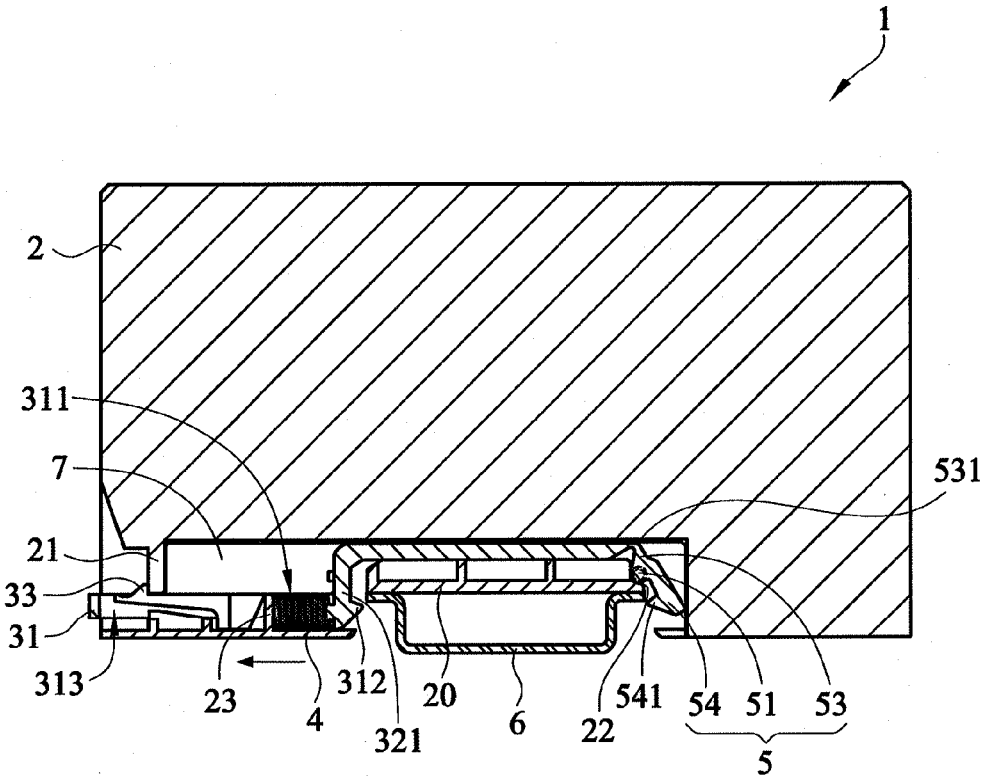
FIG. 6 shows a state of use of the first preferred embodiment of the present invention.
Figure 7:
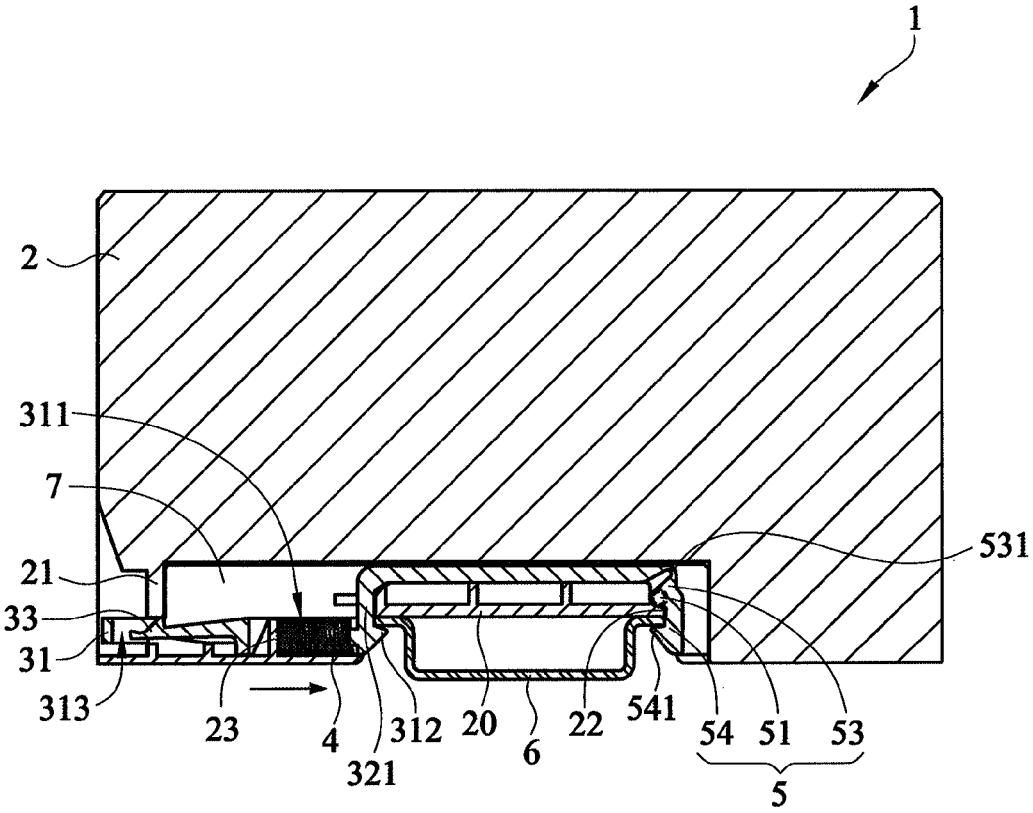
FIG. 7 shows another state of use of the first preferred embodiment of the present invention.

Please refer now to FIG. 6 and FIG. 7 in conjunction with FIG. 4 and FIG. 5, wherein FIG. 6 and FIG. 7 show different states of use of the first preferred embodiment of the present invention.

To operate the terminal block 1, or more specifically to bring the terminal block 1 into engagement with a rail 6, the operating portion 31 of the engaging member 3 is slid toward the left first, as indicated by the lower arrow in FIG. 6. Consequently, the claw 312 of the engaging member 3 is slid leftward, and the stop block 33 of the engaging member 3 corresponds to and is blocked by the left blocking portion 21 of the terminal block body 2, thus temporarily preventing the engaging member 3 from being driven by the elastic force of the elastic member 4. In the meantime, the connecting portion 32, which is connected to the operating portion 31, is also driven toward the left. Now that the connecting portion 32 is movably connected to the upper end 53 of the hook member 5, the hook member 5 is driven by the connecting portion 32 into pivotal rotation. More particularly, referring to FIG. 5, when the upper end 53 of the hook member 5 is moved leftward by the connecting portion 32, the hook member 5 pivots about the pivotal connecting portion 51 such that the hook 541 at the lower end 54 of the hook member 5 is moved toward the right.

Once the terminal block 1 is operated as described above and enters the state shown in FIG. 6 (i.e., when the claw 312 of the engaging member 3 has been slid leftward, and the hook 541 of the hook member 5 has been moved rightward such that a space is formed therebetween), the rail 6 is put into the space. After that, the operating portion 31 of the engaging member 3 is released to bring the stop block 33 of the engaging member 3 out of engagement with the left blocking portion 21 of the terminal block body 2, allowing the engaging member 3 to return to its original position under the elastic force of the elastic member 4, as indicated by the lower arrow in FIG. 7. As a result, the rail 6 is engaged with the claw 312 of the engaging member 3 and the hook 541 of the hook member 5.

During the foregoing operation, the claw 312 of the engaging member 3 and the hook 541 of the hook member 5 move simultaneously, and only a simple process is involved in engaging the terminal block 1 with the rail 6. In other words, the entire operation is easy to carry out and can be completed rapidly. Moreover, as the terminal block 1 need not be rotated or swung as required in the prior art in order to engage with the rail 6, the space needed for the operation is greatly reduced.

In this embodiment, the operating portion 31 of the engaging member 3 is formed with an operation hole 313 located at the end of the operating portion 31 that is opposite the claw 312. This allows the operating portion 31 of the engaging member 3 to be operated with a screw driver (not shown) or a similar tool inserted into the operation hole 313.

In this embodiment, the upper end 53 of the hook member 5 is movably connected to the second end of the connecting portion 32 via a flexible thin wall 531. When the hook member 5 is driven into pivotal rotation by the connecting portion 32, referring to FIG. 6 and FIG. 7, the flexible thin wall 531 is flexibly deformed, and the hook member 5 pivots under the action of the pivotal connecting portion 51 such that the hook 541 at the lower end 54 of the hook member 5 is moved.

In this embodiment, the elastic member 4 is a spring. It is understood that the elastic member 4 can alternatively be an elastic plate or other element having an elastic force.

In this embodiment, the terminal block body 2 is formed with a supporting portion 20. The engaging member 3 is slidably provided on the supporting portion 20 of the terminal block body 2 while the right end portion 22 is formed at one end of the supporting portion 20. Thus, the engaging member 3 is supported by the supporting portion 20 of the terminal block body 2 when slid in the left-right direction.

In this embodiment, the terminal block body 2 further includes a cover 7. The cover 7 covers the engaging member 3, the elastic member 4, and the hook member 5 to prevent them from contamination by dust or the like. Besides, the intermediate blocking portion 23 and the supporting portion 20 are both formed on the cover 7, and the pivotal connecting portion 51 of the hook member 5 is pivotally connected to the cover 7.

Figure 8:
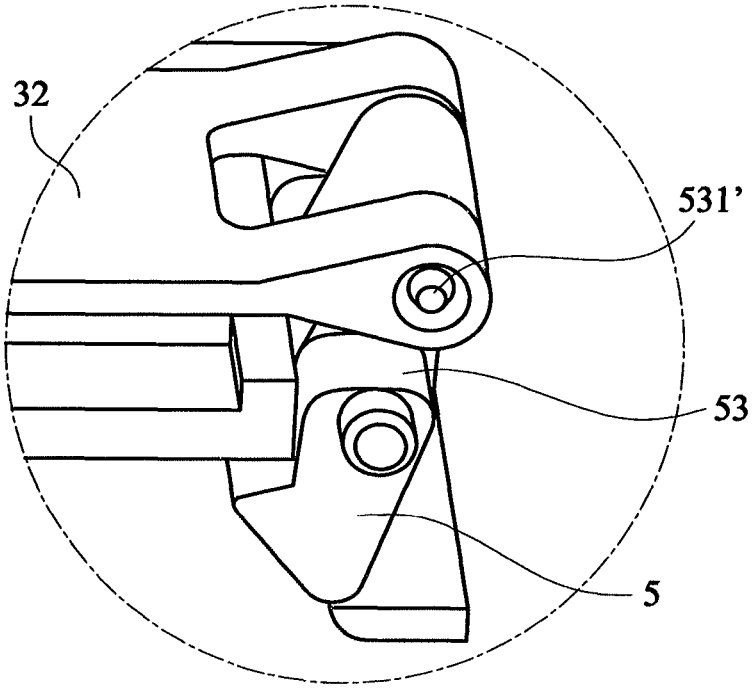
FIG. 8 is a partial view of the second preferred embodiment of the present invention, showing another arrangement for the movable connection between the connecting portion and the hook member.

Referring to FIG. 8, the second preferred embodiment of the present invention uses a different arrangement for the movable connection between the connecting portion and the hook member. The main structures of the second preferred embodiment are the same as those of the first preferred embodiment, the only difference being that the upper end 53 of the hook member 5 in the second preferred embodiment is movably connected to the second end of the connecting portion 32 via a pivot pin 531'. This alternative structural design is equally capable of the various effects of the first preferred embodiment described above, in which the upper end 53 of the hook member 5 is movably connected to the second end of the connecting portion 32 by means of the flexible thin wall 531, as shown in FIG. 6 and FIG. 7.

The embodiments provided herein are but some preferred embodiments of the present invention and are not intended to be restrictive of the present invention. All modifications, equivalent substitutions, and improvements made according to the spirit and principle of the present invention should fall within the scope of the present invention.

What is claimed is:

1. A terminal block with an improved rail-engaging structure, the terminal block comprising:

a terminal block body comprising a left blocking portion, a right end portion, and an intermediate blocking portion located between the left blocking portion and the right end portion;

an engaging member slidably provided on the terminal block body, the engaging member comprising an operating portion, a connecting portion, and a stop block, wherein the operating portion is formed with a receiving groove and has an end facing the right end portion and protrudingly provided with a claw, the connecting portion has an end connected to the operating portion such that a blocking portion is formed where the end of the connecting portion is connected with the operating portion, and the stop block is protrudingly provided on the operating portion and is adjacent to the left blocking portion so as to correspond to and be blocked by the left blocking portion;

an elastic member provided in the receiving groove and pressed between the intermediate blocking portion and the blocking portion, the elastic member having an elastic force; and a hook member comprising a pivotal connecting portion, an upper end, and a lower end, wherein the pivotal connecting portion is located between the upper end and the lower end and is pivotally connected to the terminal block body, the upper end is movably connected to an opposite end of the connecting portion, and the lower end is protrudingly provided with a hook facing the left blocking portion.

2. The terminal block of claim 1, wherein the operating portion has an end which is opposite the end protrudingly provided with the claw and which is formed with an operation hole.

3. The terminal block of claim 1, wherein the upper end is movably connected to the opposite end of the connecting portion via a flexible thin wall.

4. The terminal block of claim 1, wherein the upper end is movably connected to the opposite end of the connecting portion via a pivot pin.

5. The terminal block of claim 1, wherein the elastic member is a spring.

6. The terminal block of claim 1, wherein the terminal block body is formed with a supporting portion, the engaging member is slidably provided on the supporting portion of the terminal block body, and the right end portion is formed at an end of the supporting portion.

7. The terminal block of claim 6, wherein the terminal block body further comprises a cover covering the engaging member, the elastic member, and the hook member, the intermediate blocking portion and the supporting portion are formed on the cover, and the pivotal connecting portion of the hook member is pivotally connected to the cover.

* * * * *